US005432699A

United States Patent [19]

Hache et al.

[11] Patent Number: 5,432,699

[45] Date of Patent: Jul. 11, 1995

[54] MOTION COMPENSATION APPARATUS AND METHOD OF GYROSCOPIC INSTRUMENTS FOR DETERMINING HEADING OF A BOREHOLE

[75] Inventors: Jean-Michel Hache, Sugar Land, Tex.; Pierre A. Moulin, Chaville, France; Wayne J. Phillips, Houston, Tex.

[73] Assignee: Schlumberger Technology Corporation, Sugar Land, Tex.

[21] Appl. No.: 130,960

[22] Filed: Oct. 4, 1993

[51] Int. Cl.[6] ..... E21B 47/022

[52] U.S. Cl. ..... 364/422

[58] Field of Search ..... 364/422; 175/45; 33/304, 312, 313; 166/250; 324/346, 351, 369, 326

[56] References Cited

U.S. PATENT DOCUMENTS

| | | | |
|---|---|---|---|
| 4,472,884 | 9/1984 | Engebretson | 33/304 |
| 4,542,647 | 9/1985 | Molnar | 33/304 |
| 4,768,152 | 8/1988 | Egli et al. | 364/422 |
| 4,783,742 | 11/1988 | Peters | 364/422 |
| 4,812,977 | 3/1989 | Hulsing, II | 364/422 |
| 5,128,867 | 7/1992 | Helm | 364/422 |

*Primary Examiner*—Robert A. Weinhardt

*Attorney, Agent, or Firm*—Gary L. Bush; Wayne I. Kanak

[57] ABSTRACT

A method and apparatus is disclosed for measuring motion signals of gyroscopes in downhole instruments used to determine the heading of a borehole. An illustrative embodiment of the invention includes a measuring-while-drilling system which may experience motion even while the drill string is suspended in rotary table slips when the heading of the drill string is being determined. Accelerometer and magnetometer data along three orthogonal axes of a measurement sub are used to obtain unit gravitational vectors g at a first time and at a second time and unit magnetic vectors h at the first time and the second time. The difference between the two unit gravitational vectors at the different times, $\Delta g$, and the difference between the two unit magnetic vectors at the different times, $\Delta h$, are used along with the unit vectors g and h and the difference in time $\Delta t$ to determine the rotation vector of the probe $\Omega^p$ which has occurred during such time difference. The vector representing the rotation of the earth, $\Omega^e$ is then determined by subtracting $\Omega^p$ from the vector $\Omega^g$ from three gyroscope instruments placed along the axes of the measurement sub. The heading of the drill string is determined from the gravitational vector and the earth rotation vector.

12 Claims, 6 Drawing Sheets

MOTION COMPENSATION APPARATUS AND METHOD OF GYROSCOPIC INSTRUMENTS FOR DETERMINING HEADING OF A BOREHOLE

BACKGROUND OF THE INVENTION

1. Field of the Invention

This invention finds application in certain measurement systems which determine the heading of a borehole of a well. For example, the invention relates to measuring-while-drilling systems (MWD) which are designed to determine the position and heading of a tandemly connected sub near the drill bit of a drill string assembly in an oil or gas well borehole. The invention also finds application with wireline apparatus in which one or more down-hole instruments are designed to determine the position and heading of such instrument(s) during logging of an open hole borehole. In particular, the invention relates to the determination of the heading of the well from gyroscopic data regarding the earth's rotation and from accelerometer data regarding the earth's gravitational field. Still more particularly, the invention relates to an apparatus and method for compensating gyroscopic data for movement of a down-hole measurement instrument while a heading determination is being made.

2. Description of the Prior Art

Prior art measuring-while-drilling equipment has included magnetometers and accelerometers disposed on each of three orthogonal axes of a measurement sub of a drill string assembly. Such measurement sub has typically been part of a special drill collar placed a relatively short distance above a drilling bit. The drilling bit bores the earth formation as the drill string is turned by a rotary table of a drilling rig at the surface.

At periodic intervals, the drill string is stopped from turning so that the measurement sub in the well boremay generate magnetometer data regarding the earth's magnetic field and accelerometer data regarding the earth's gravitational field with respect to the orthogonal axes of the measurement sub. The h vector from the magnetometer data and the g vector from the accelerometer data are then used to determine the heading of the well.

Such prior art method suffers from the fact that the earth's magnetic field varies with time and is affected by structures containing iron or magnetic ores in the vicinity of the measurement sub. Such variation leads to errors and uncertainty in the determination of the well heading.

Such variation in the heading determination of the measurement sub of a MWD assembly, or a similar wireline instrument, can theoretically be eliminated by adding gyroscopes to each of the orthogonal axes of the measurement sub. In theory, the heading of the measurement sub can then be determined from accelerometer data from each of such axes and gyroscopic data from each of such axes. The accelerometer data is responsive to the gravitational field of the earth, while the gyroscopic data is responsive to the rotational velocity of the earth with respect to inertial space.

Movement of the measurement sub (in the case of an MWD application) while accelerometer and gyroscopic data is being taken can introduce an error into the determination of the earth's rotational velocity vector. Such movement may be caused by the "twist" or torque on the drill string after it is stopped from rotation and it is suspended from slips in the rig rotary table.

Such twisting motion may occur on land rigs or on floating drilling rigs. Motion may also be produced while drilling has been suspended for a heading determination in a floating drilling rig where the heave of the sea causes the drill string to rise and fall in the borehole. Rotation of such drill string may be caused due to wave induced reciprocation of the measurement sub along a curved borehole. Analogous errors may occur in the case of a wireline instrument.

SUMMARY OF THE INVENTION

A primary object of this invention is to provide an apparatus and method to compensate for rotation induced errors for an instrument which uses gyroscopic measurements for determining the heading of a borehole.

An important object of this invention is to provide a specific application of the invention in an apparatus and method for compensating gyroscopic measurements of a MWD measurement sub for rotation of the measurement sub itself while accelerometer and gyroscopic measurements are being made.

Another object of this invention is to provide a measurement apparatus and method for determining the direction of a well through the use of accelerometer and gyroscopic measurements where possible corrections for rotation of the apparatus are measured using acoelerometer and magnetometer measurements.

The objects identified above, along with other advantages and features of the invention are illustrated in a preferred embodiment in a method and apparatus for reducing a source of error in measuring-while-drilling (MWD) equipment. The invention is also intended for application in wireline instruments. In the MWD application of the invention, a measurement sub is provided having a separate accelerometer, magnetometer and gyroscope fixed along each of x, y and z axes of a sub coordinate system. An error is produced in gyroscope signals by the motion of the measurement sub in a drilling string while the string is suspended in a rotary table, during the time that a determination of the sub's heading with respect to the earth is conducted. A unit vector representing the earth's magnetic field with respect to the sub coordinate system is determined at a first time $t_1$ and again at a second time $t_2$ to produce unit vectors $h_{t1}$ and $h_{t2}$ and a difference unit earth magnetic field vector, $\Delta h$. A unit vector representing the earth's gravitational field with respect to the sub coordinate system is determined at the first time $t_1$ and again at the second time $t_2$ to produce unit vectors $g_{t1}$ and $g_{t2}$ and a difference unit earth's gravitational field vector, $\Delta g$. The time difference $\Delta t$ between $t_1$ and $t_2$ is also determined. From the vectors $\Delta h$, $h_{t1}$, $\Delta g$, $g_{t1}$ and the time difference $\Delta t$, a vector $\Omega^p$ representative of the angular rotation velocity of the measurement sub or "probe" is determined. Determination of $\Omega^p$ allows the gyroscopic vector measured during such time, $\Omega^g$, to be corrected to determine the actual earth's rotational velocity vector $\Omega^e$. Such vector and its components along with the accelerometer determination of the earth's gravitational field allow a determination of the heading or the direction of the well bore.

BRIEF DESCRIPTION OF THE DRAWINGS

The objects, advantages and features of the invention will become more apparent by reference to the drawings which are appended hereto and wherein like numerals indicate like elements and wherein an illustrative embodiment of the invention is shown, of which.

DESCRIPTION OF THE INVENTION

Figure 1:
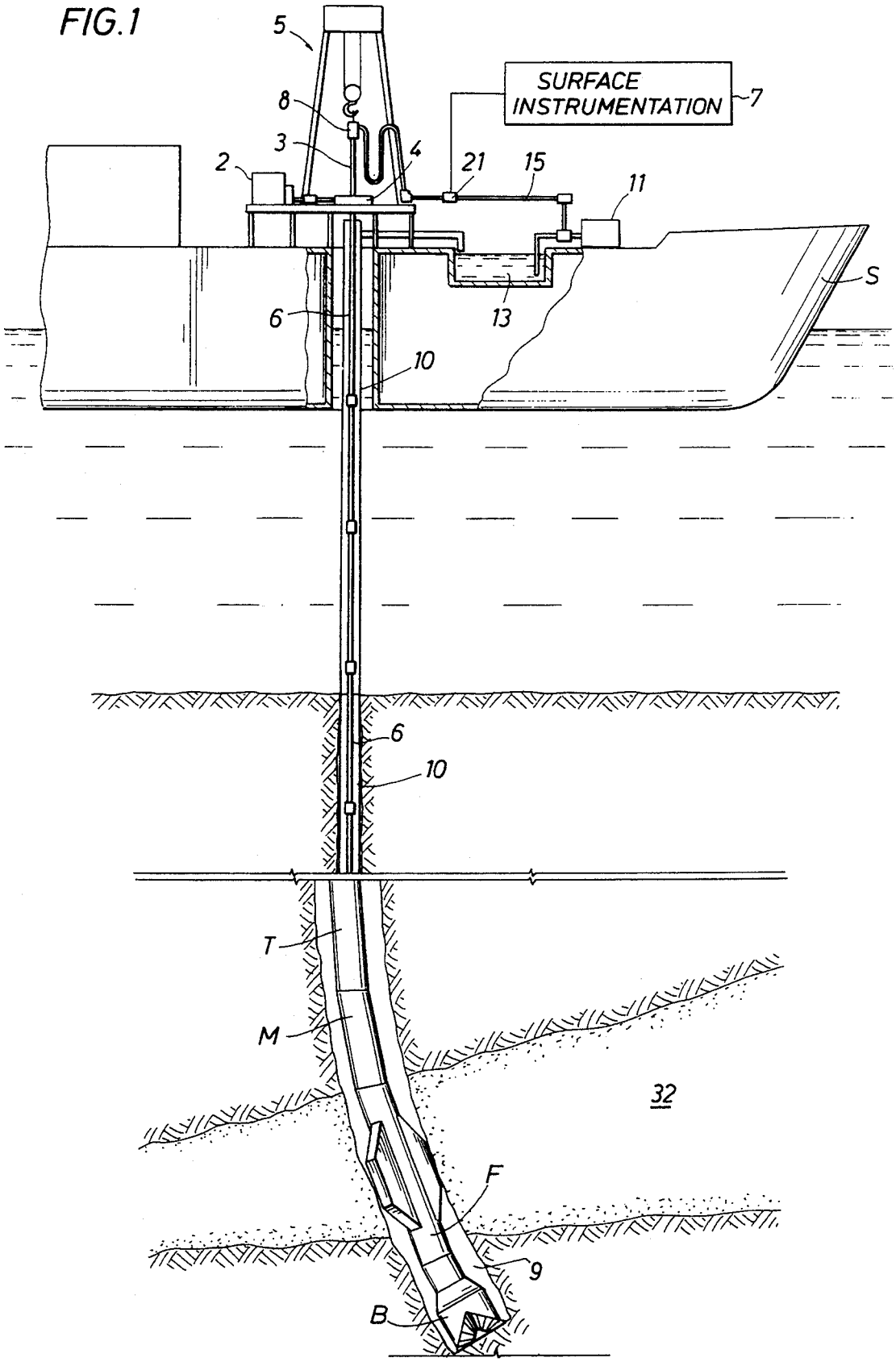
FIG. 1 is a shematic representation of a measuring-while-drilling system including a floating drill ship and a downhole measurement sub constructed in accordance with the invention.

FIG. 1 represents an illustrative embodiment of the invention for a MWD application. As mentioned above, the invention also may find application for a wireline measurement system. A drilling ship S which includes a typical rotary drilling rig system 5 having subsurface apparatus for making measurements of formation characteristics while drilling. Although the invention is described for illustration in a MWD drilling ship environment, the invention will find application in MWD systems for land drilling and with other types of offshore drilling.

The downhole apparatus is suspended from a drill string 6 which is turned by a rotary table 4 on the drill ship. Such downhole apparatus includes a drill bit B and one or more drill collars such as the drill collar F illustrated with stabilizer blades in FIG. 1. Such drill collars may be equipped with sensors for measuring resistivity, or porosity or other characteristics with electrical or nuclear or acoustic instruments.

The signals representing measurements of instruments of collars F (which may or may not include the illustrated stabilizer blades) are stored downhole. Such signals may be telemetered to the surface via conventional measuring-while-drilling telemetering apparatus and methods. For that purpose, a MWD telemetering sub T is provided with the downhole apparatus. It receives signals from instruments of collar F, and from measurement sub M described below, and telemeters them via the mud path of drill string 6 and ultimately to surface instrumentation 7 via a pressure sensor 21 in standpipe 15.

Drilling rig system 5 includes a motor 2 which turns a kelly 3 by means of the rotary table 4. The drill string 6 includes sections of drill pipe connected end-to-end to the kelly 3 and is turned thereby. The measurement sub or collar M of this invention, as well as other conventional collars F and other MWD tools, are attached to the drill string 6. Such collars and tools form a bottom hole drilling assembly between the drill string 6 and the drill bit B.

As the drill string 6 and the bottom hole assembly turn, the drill bit B bores the borehole 9 through earth formations 32. An annulus 10 is defined as the portion of the borehole 9 between the outside of the drill string 6 including the bottom hole assembly and the earth formations 32. Such annulus is formed by tubular casing running from the ship to at least a top portion of the borehole through the sea bed.

Drilling fluid or "mud" is forced by pump 11 from mud pit 13 via standpipe 15 and revolving injector head 8 through the hollow center of kelly 3 and drill string 6, through the subs T, M and F to the bit B. The mud acts to lubricate drill bit B and to carry borehole cuttings upwardly to the surface via annulus 10. The mud is delivered to mud pit 13 where it is separated from borehole cuttings and the like, degassed, and returned for application again to the drill string.

Figure 2A:
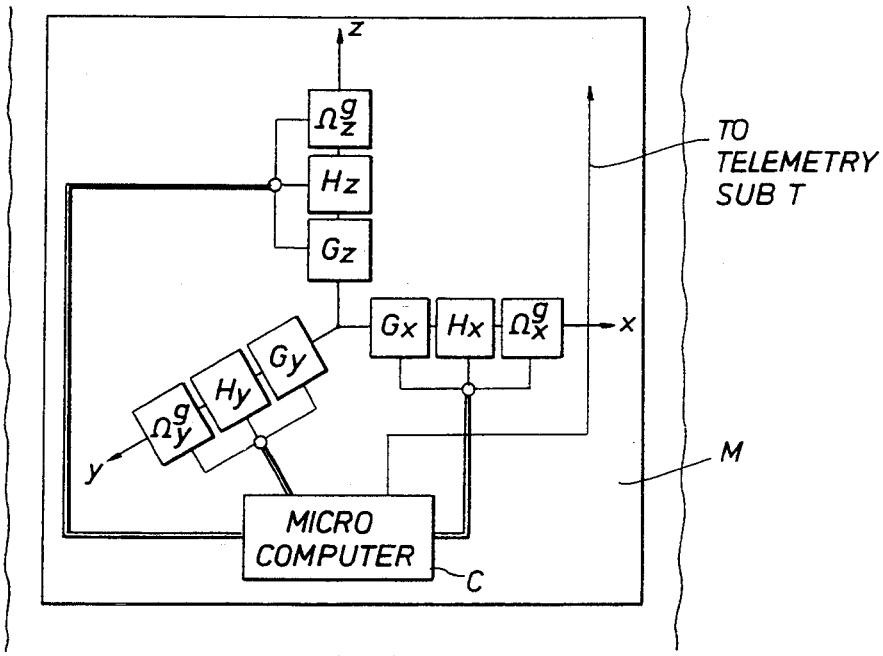
FIG. 2A is a schematic representation of the downhole measurement sub with an accelerometer, magnetometer and a gyroscope placed along orthogonal axes of the sub.
Figure 2B:
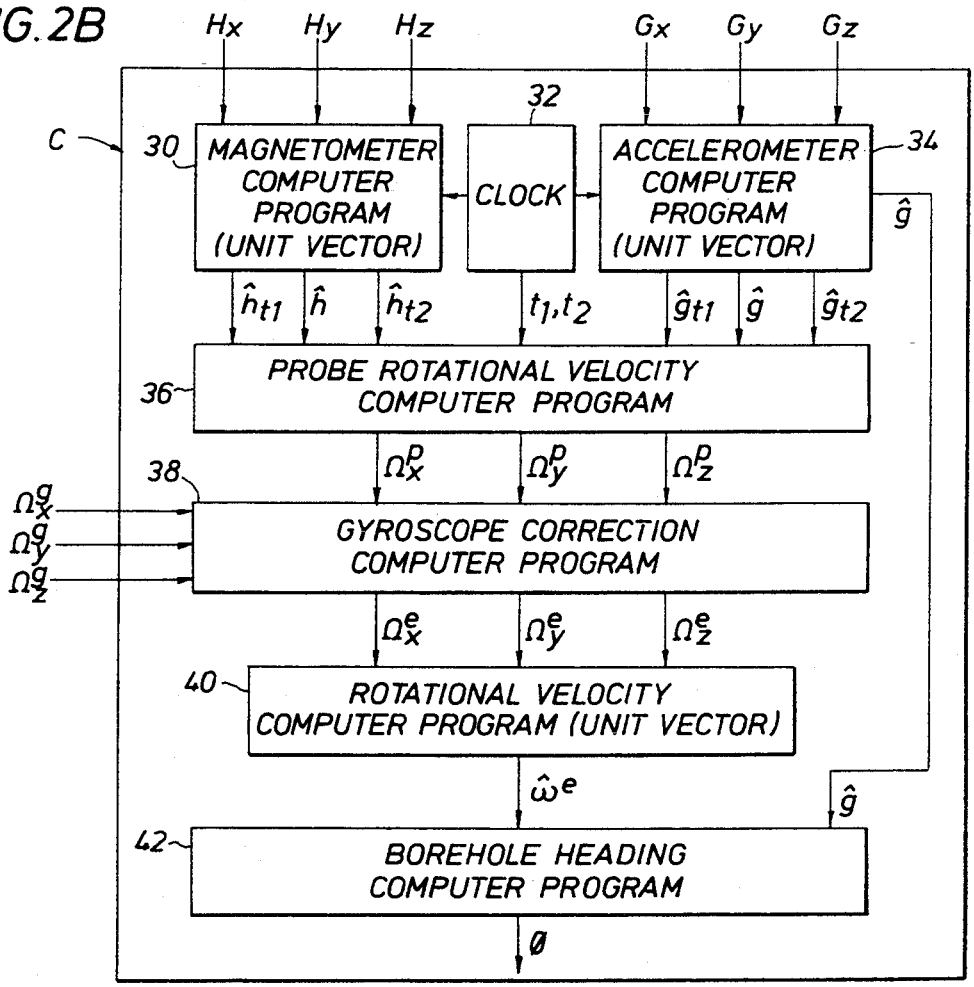
FIG. 2B is a schematic representation of a microcomputer in the measurement sub with various computer programs to determine the heading of the sub while it is downhole using accelerometer data and gyroscopic data where the gyroscopic data has been corrected for movement of the sub itself.

Measurement sub M, as illustrated in FIGS. 2A and 2B is provided to measure the position of the downhole assembly in the borehole. Such borehole may be curved or inclined with respect to the vertical, especially in offshore wells. The sub M includes a structure to define x, y and z orthogonal axes. The z axis is coaxial with sub M. On each axis, a separate accelerometer, magnetometer and gyroscope is mounted. In other words, signals represented as $G_x$, $H_x$, $\Omega g_x$; $G_y$, $H_y$, $\Omega g_y$; and $G_z$, $H_z$, $\Omega g_z$ are produced and applied to micro computer C disposed in sub M. Such signals are transformed to digital representations of the measurements of the instruments for manipulation by computer C.

The signals $G_x$, $G_y$ and $G_z$ represent accelerometer output signals oriented along the x, y, z axes of the sub M; $H_x$, $H_y$, and $H_z$ signals represent magnetometer signals; $\Omega g_x$, $\Omega g_y$, and $\Omega g_z$ signals represent gyroscope signals.

In operation, drilling is stopped periodically, so that measurements of sub M can be performed to determine the heading $\phi$ with respect to the vertical. In other words, a heading of $\phi=0$ means that the well is inclining or heading toward earth's geographic north. A heading of $\phi=90°$ means that the well is inclining toward the east, and so on.

The heading of the wellbore can be found using the tri-axial set of accelerometers $G_x$, $G_y$, $G_z$ and the tri-axial set of gyroscopes $\Omega g_x$, $\Omega g_y$, $\Omega g_z$, to resolve the earth's gravitational field G and the earth's rotation vector $\Omega^e$ into their components along three orthogonal axes. The rotation vector $\Omega^2$ represents angular velocity of the earth with respect to inertial space.

If the z axis of the measurement sub M is parallel to the axis of the wellbore, the direction of the borehole $\phi$ can be determined from the vector components of $\vec{G}$ and $\Omega^e$ as $$\tan(\phi) = \frac{g_x\omega_y{}^e - g_y\omega_x{}^e}{\hat{\omega}_z{}^e - (g \cdot \omega^e)g_z} \tag{1}$$

where $g = \frac{G}{|G|}$ is a unit gravitational vector with components $g_x$, $g_y$, $g_z$ and $\omega^e = \frac{\Omega^e}{|\Omega^e|}$ is a unit earth rotational vector with components $\omega_x{}^e$, $\omega_y{}^e$, $\omega_z{}^e$.

The term $|\vec{g}|$, or absolute value of the accelerometer vector is defined as $$|G| = \sqrt{G_x{}^2 + G_y{}^2 + G_z{}^2}$$

The angular velocity vector $\Omega g$ as measured by the gyroscopes is the sum of the angular velocity vector $\Omega^e$ of the earth and the angular velocity vector $\Omega^p$ of the probe. In other words, $$\Omega^g = \Omega^e + \Omega^p$$

When the drill string 6 is suspended in the rotary table 4 by slips and is not being rotated, the motion of the measurement sub M in the borehole can be a large source of error for the gyroscopes. Such motion may result from twisting of the drill string due to residual torsional energy of the drill string after it is stopped from turning. Such motion may also take the form of up and down motion of the drill string caused by the heave of the drill ship S. As a result, measurement sub M slides up and down along the curve of an inclined borehole during the time of the heading determination. In other words, the gyroscopic measurements are corrupted with measurements of the rotation of the sub M itself.

This invention includes apparatus and a method for independently determining the rotation velocity vector $\Omega^p$ of the sub or "probe" relative to the earth, and then determining the earth's rotation vector $\Omega^e$ by subtracting $\Omega^p$ from the rotation vector $\Omega^g$ determined from the gyroscopes.

The effect of the rotation of the measurement sub M relative to the earth on a unit vector fixed in the earth can be written as $$\frac{du}{dt} = u \times \Omega^p \tag{2}$$

For finite time steps, equation (2) becomes $$\Delta u = u \times \Omega^p \Delta t \tag{3}$$

The vector $\Omega^p$ can be resolved into components parallel and perpendicular to $\hat{u}$ by forming the cross products of the left and right hand sides of equation (3) with $\hat{u}$:

$$\Delta u \times u = (u \times \Omega^p \Delta t) \times u,$$

$$\Delta u \times u = \Omega^p \Delta t - (u \cdot \Omega^p \Delta t)\, u$$

or $$\Omega^p \Delta t = \Delta u \times u + (u \cdot \Omega^p \Delta t) u \tag{4}$$

In equation (4), $\Omega^p \Delta t$ is expressed as the sum of two components. The component $\Delta\hat{u} \times \hat{u}$ is perpendicular to $\hat{u}$. The term $(\hat{u} \cdot \Omega^p \Delta t)\hat{u}$ is parallel to $\hat{u}$.

Because the gravitational field vector $\vec{G}$ (obtained from $G_x$, $G_y$, $G_z$ accelerometers) and the magnetic field vector $\vec{H}$ (obtained from $H_x$, $H_y$, $H_z$ magnetometers) are both fixed in the earth's frame of reference, two equations can be written for $\Omega^p \Delta t$:

$$\Omega^p \Delta t = \Delta g \times g + (g \cdot \Omega^p \Delta t) g \tag{5}$$

and $$\Omega^p \Delta t = \Delta h \times h + (h \cdot \Omega^p \Delta t) h \tag{6}$$

where g and h are unit vectors along the earth's gravitational field vector $\vec{G}$ and the earth magnetic field vector $\vec{H}$, $$g = \frac{G}{|G|}, \text{ where } |G| = \sqrt{G_x^2 + G_y^2 + G_z^2}$$

and

-continued $$h = \frac{H}{|H|}, \text{ where } |H| = \sqrt{H_x^2 + H_y^2 + H_z^2}$$

Equating the right hand sides of equations (5) and (6), the equation becomes, $$\Delta g \times g + (g \cdot \Omega^p \Delta t) g = \Delta h \times h + (h \cdot \Omega^p \Delta t) h \tag{7}$$

Two equations for the unknowns $(g \cdot \Omega^p \Delta t)$ and $(h \cdot \Omega^p \Delta t)$, are obtained, for example, by forming the dot products of equation (7) with any two linearly independent vectors $\vec{A}$ and $\vec{B}$:

$$(\Delta g \times g) \cdot A + (g \cdot \Omega^p \Delta t) g \cdot A = (\Delta h \times h) \cdot A + (h \cdot \Omega^p \Delta t) h \cdot A \tag{8}$$

$$(\Delta g \times g) \cdot B + (g \cdot \Omega^p \Delta t) g \cdot B = (\Delta h \times h) \cdot B + (h \cdot \Omega^p \Delta t) h \cdot B \tag{9}$$

Equations (8) and (9) can be put in matrix form and solved for $(g \cdot \Omega^p \Delta t)$ and $(h \cdot \Omega^p \Delta t)$:

$$\begin{bmatrix} g \cdot A - h \cdot A \\ g \cdot B - h \cdot B \end{bmatrix} \begin{bmatrix} g \cdot \Omega^p \Delta t \\ h \cdot \Omega^p \Delta t \end{bmatrix} = \begin{bmatrix} (\Delta h \times h) \cdot A - (\Delta g \times g) \cdot A \\ (\Delta h \times h) \cdot B - (\Delta g \times g) \cdot B \end{bmatrix} \tag{10}$$

One possible solution of equations (8) and (9) is to choose $$\vec{A} = \Delta h \times h, \text{ and}$$

$$\vec{B} = \Delta g \times g.$$

For such a selection, equation (8) can be solved directly for $(g \cdot \Omega^p \Delta t)$ and equation 9 solved directly for $h \cdot \Omega^p \Delta t$.

FIG. 2B illustrates the microcomputer C which is disposed in measurement sub M. Several computer programs or sub-routines are stored in micro computer C to accept representation of signals from each of the accelerometers, magnetometers and gyroscopes.

Figure 3A:
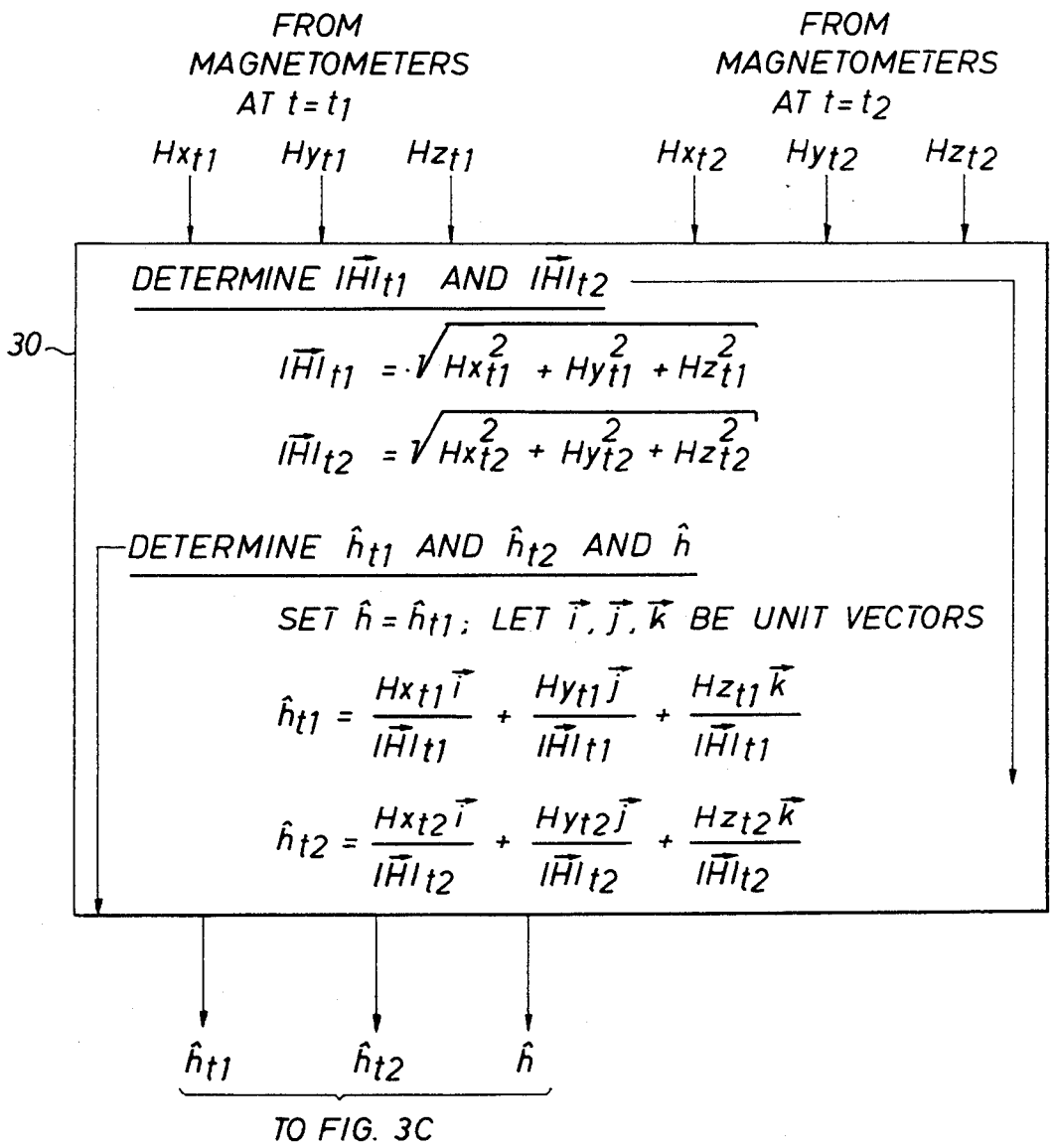
FIGS. 3A–3F are flow charts illustrating various computer programs referenced in FIG. 2B.
Figure 3B:
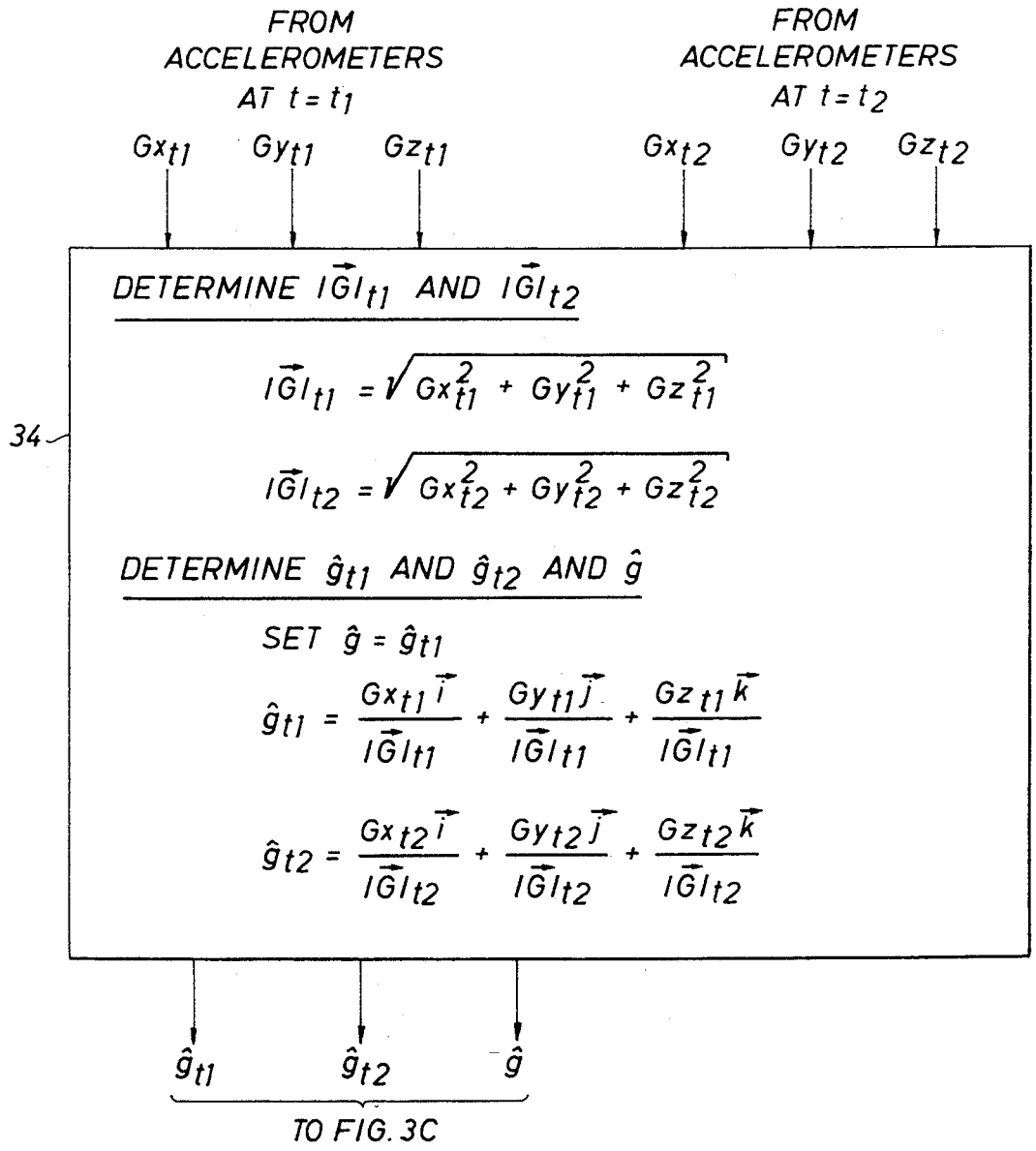

Computer program 30, labeled Magnetometer Computer program (unit vector), (see also the flow chart of FIG. 3A) accepts magnetometer signals $H_x$, $H_y$ and $H_z$ signals at times $t_1$ and $t_2$ as received from clock 32. The unit vector h is determined at each of times $t_1$ and $t_2$. A representation of the unit vectors $h_{t1}$ and $h_{t2}$ is applied to computer program 36 for further use. In the same way, the computer program or sub-routine 34 (see also the flow chart of FIG. 3B) accepts signals $G_x$, $G_y$, $G_z$ from accelerometers of measurement sub M. Computer program 34 determines unit gravitational field vectors at the times $t_1$ and $t_2$. Such vectors $g_{t1}$ and $g_{t2}$ are applied to program 36.

Figure 3C:
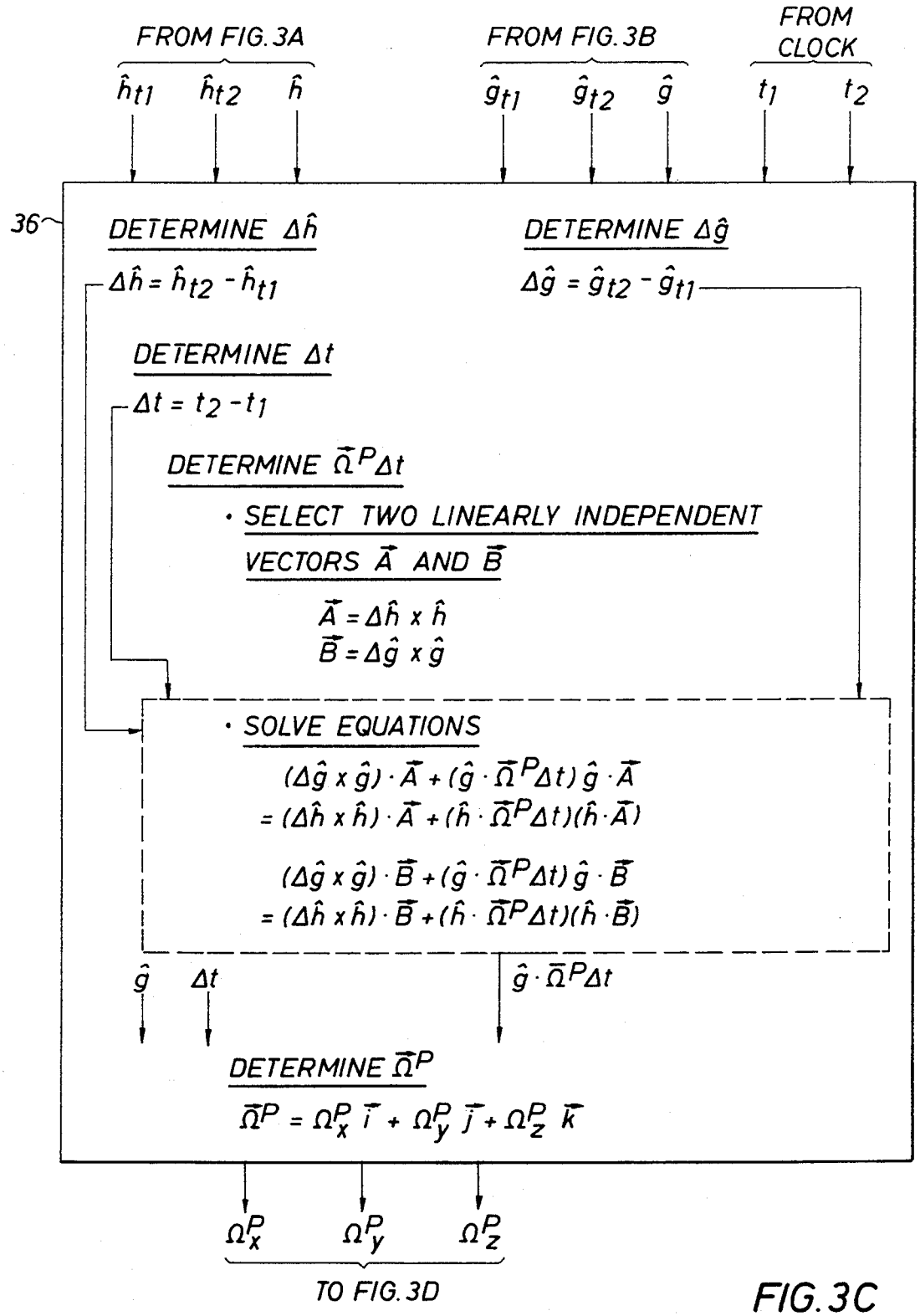

The computer program 36, illustrated in FIG. 3C, first determines the difference between sequential measurements of $g_{t1}$ and $g_{t2}$ and $h_{t1}$ and $h_{t2}$. In other words, a representation of $\Delta g$ and $\Delta h$ is determined. The representation of $\Delta t$, the time difference between the sequential measurement times, is also applied to computer program 36.

Figure 3D:
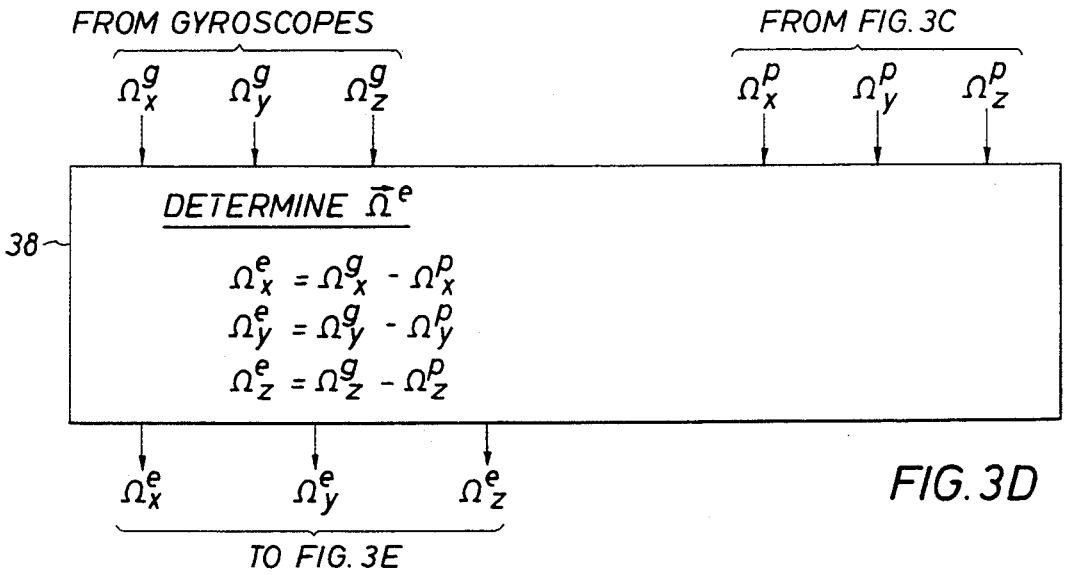
Figure 3E:
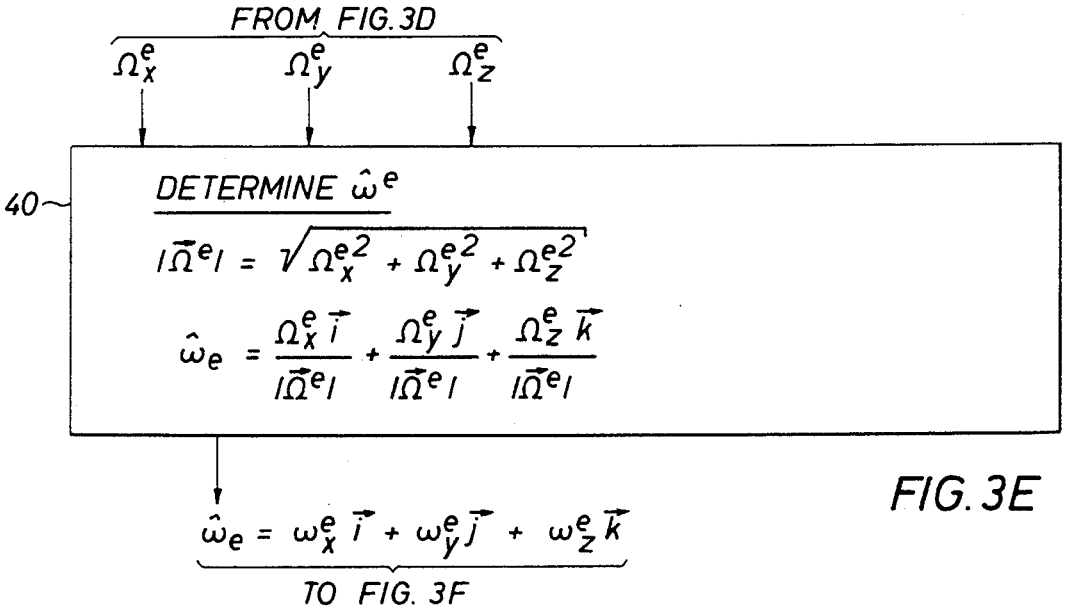

Computer program 36 uses representations of $\Delta g$, g, $\Delta h$, h along with arbitrary vectors $\vec{A}$ and $\vec{B}$ ($\vec{A}$ and $\vec{B}$ selected to be linearly independent of one another) to produce a representation of $\Omega^p \Delta t$. Either the $g_{t1}$, or the $g_{t2}$ or the mean value between such vectors may be used as g. Likewise, the $h_{t1}$ or the $h_{t2}$ or the mean value between such vectors may be used as h. The program 36 has a data input of $\Delta t$ from clock 32. Accordingly, the $\Delta t$ representation is used with the representations of $\Omega^p \Delta t$ to produce representations of $\Omega^p_x$, $\Omega^p_y$, $\Omega^p_z$ which are applied to gyroscope correction computer program or sub-routine 38, which is illustrated in the flow chart of FIG. 3D. Program 38 also accepts gyroscope signals $\Omega g_x$, $\Omega g_y$, $\Omega g_z$. It then determines the difference of the probe rotation signals $\Omega^p_x$, $\Omega^p_y$, $\Omega^p_z$ from the gyroscope signals $\Omega g_x$, $\Omega g_y$, $\Omega g_z$ to produce corrected earth rotation signals, $\Omega^e_x$, $\Omega^e_y$, $\Omega^e_z$ for application to computer program or sub-routine 40 illustrated in FIG. 3E which produces the unit vector $\omega_e$ representative of the earth's rotation vector, that is, $$\omega_e = \frac{\Omega^e}{|\Omega^e|}, \text{ where } |\Omega^e| = \sqrt{\Omega_x^{e2} + \Omega_y^{e2} + \Omega_z^{e2}}.$$

Figure 3F:
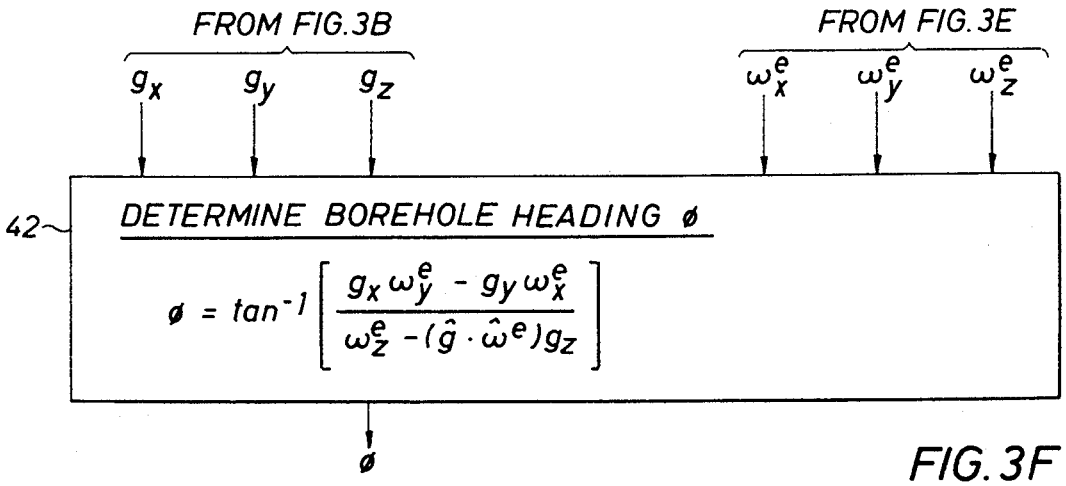

Next, the representation of the unit vector $\omega_e$ is combined with the representation of the unit vector g from program 34 to determine a corrected borehole heading $\phi$ according to the relationship of equation (1) above. The flow chart illustration of the computer program to accomplish the determination of heading $\phi$ is illustrated in FIG. 3F. The signal $\phi$ is applied to telemetry module T for transmission to surface instrumentation via the mud column of drill string 6, standpipe 15 and pressure sensor 21 as illustrated in FIG. 1.

Practical aspects of the invention deserve mention. The gyroscopes used in this invention are preferably ring laser gyros. Fiber optic gyros or mechanical spinning mass gyroscopes may be used which are suitably protected to survive mechanical shocks of a downhole drilling environment.

The method outlined above does not take into account sources of uncertainty in the measurement of g and h. Errors in the measured g and h time sequences can result in an inequality between the left and right hand sides of equation (7). Since equation (7) is a vector and must hold along any coordinate axis, it is in fact equivalent to three scalar equations.

Since there are three equations and only two free parameters, the system of equations is over constrained. The method described above guarantees that the left and right hand sides of equation (7) will be equal in a plane containing the vectors $\vec{A}$ and $\vec{B}$ but they may not be equal on a line perpendicular to that plane as a result of errors in the measurement of g and h. The value of $\Omega^p$ obtained will depend on the choice of vectors $\vec{A}$ and $\vec{B}$ which has been made arbitrarily and without any consideration of which choice is "best". It is useful to determine the "best" estimate of the true rotational velocity of the probe given the uncertainties in the measurement of $\Delta g$ and $\Delta h$.

Since $\Delta g$ and $\Delta h$ are both 3 dimensional vectors, a single measurement of $\Delta g$ and $\Delta h$ can be viewed as a single sample of a 6 dimensional random vector. The uncertainties in the measurements can be expressed in the form of a $6 \times 6$ covariance matrix, K, in which each element of the covariance matrix is the covariance between two of the components of the random vector. The covariance matrix can be determined by analyzing the sources of uncertainty in the measurement of $\Delta g$ and $\Delta h$. Assuming that distribution of measurements of $\Delta g$ and $\Delta h$ obey a Gaussian distribution for multidimensional random variables, it is necessary to find the value of $\Omega^p$ which maximizes the probability of obtaining the observed values of $\Delta g$ and $\Delta h$. The maximum likelihood estimates of $\Delta g$ and $\Delta h$, $\Delta g_{ml}$ and $\Delta h_{ml}$, are computed from the maximum likelihood estimate of $\Omega^p$ from the equations:

$$\Delta g_{ml} = (g \times \Omega^p_{ml})\Delta t$$

$$\Delta h_{ml} = (h \times e, rar\ \Omega^p_{ml})\Delta t$$

The probability of observing the measured value of $\Delta g$ and $\Delta h$ is proportional to the quantity:

$$\exp\left[-\tfrac{1}{2}\begin{pmatrix}\Delta g - \Delta g_{ml}\\ \Delta h - \Delta h_{ml}\end{pmatrix}^T \cdot K^{-1} \cdot \begin{pmatrix}\Delta g - \Delta g_{ml}\\ \Delta h - \Delta h_{ml}\end{pmatrix}\right]$$

To maximize the probability of observing the measured values of $\Delta g$ and $\Delta h$, the factor in the exponential is minimized by treating the three components of $\Omega^p$ as free parameters which are allowed to vary. The value of $\Omega^p$ so determined is the maximum likelihood estimate of $\Omega^p$, $\Omega^p_{ml}$.

Various modifications and alterations in the described methods and apparatus which do not depart from the spirit of the invention will be apparent to those skilled in the art of the foregoing description. For this reason, these changes are desired to be included in the appended claims. The appended claims recite the only limitation to the present invention. The descriptive manner which is employed for setting forth the embodiments should be interpreted as illustrative but not limitative.

What is claimed:

1. Apparatus operatively arranged for measuring characteristics of a borehole instrument comprising, a measurement instrument operatively arranged for placement within said borehole, said instrument having a separate accelerometer and magnetometer fixed along each of z, x and y axes of an instrument coordinate system, computer means responsive to signals from said magnetometers for determining a unit vector signal representing the earth's magnetic field with respect to said instrument coordinate system at a first time $t_1$, that is $h_{t1}$, and at a later time $t_2$, that is $h_{t2}$, and for determining a difference unit earth magnetic field vector signal, $\Delta h$, representing that difference between $h_{t2}$ and $h_{t1}$; and for storing signals representative of $\Delta h$ and h, where h is selected as equal to $h_{t2}$ or $h_{t1}$ or the mean value between $h_{t2}$ and $h_{t1}$, computer means responsive to said accelerometers for determining a unit vector signal representing the earth's gravitational field with respect to said instrument coordinate system at said first time $t_1$, that is $g_{t1}$, and at a later time $t_2$, that is $g_{t2}$, and for determining a difference unit earth gravitational field vector signal, $\Delta g$, representing the difference between $g_{t2}$ and $g_{t1}$; and for storing signals representative of $\Delta g$ and g, where g is selected as equal to $g_{t2}$ or $g_{t1}$ or the mean value between $g_{t2}$ and $g_{t1}$, means for generating a signal representative of the difference in time $\Delta t$ between said first time $t_1$ and said second time $t_2$, and computer means responsive to said signals representative of $\Delta h$, h, $\Delta g$, g and $\Delta t$ for determining a vector signal $\Omega^p$ representative of the angular rotation velocity of said instrument.

2. The apparatus of claim 1 wherein said instrument is a measurement sub operatively arranged for tandem connection to a drill string.

3. The apparatus of claim 2 further comprising a separate gyroscope fixed along each of said z, x and y axes of said instrument coordinate system, computer means responsive to said gyroscopes for determining a vector signal $\Omega^g$ representative of the rotational velocity of the earth and the rotational velocity of said measurement sub and for storing said signal representative of said vector $\Omega^g$, and computer means for producing a vector signal representative of the earth's rotational velocity $\Omega^e$ with respect to said sub coordinate system by subtracting said vector $\Omega^p$ from said vector signal $\Omega^g$.

4. The apparatus of claim 3 further operatively arranged for measuring the direction of a borehole in which said measurement instrument is placed and further including, computer means responsive to said vector signals representative of components of said earth's rotational velocity $\Omega^e$ and to said vector signals representative of components of said earth's gravitational field to generate a signal representative of the direction $\phi$ of the borehole.

5. The apparatus of claim 1 wherein said computer means for determining a vector signal $\Omega^p$ includes means for solving the equation, $$\Delta g \times g + (g \cdot \Omega^p \Delta t) g = \Delta h \times h + (h \cdot \Omega^p \Delta t) h.$$

6. In apparatus including an instrument having a separate accelerometer and magnetometer fixed along each of z, x and y axes of its coordinate system, a method for determining the angular rotation velocity of the instrument when placed within a borehole comprising the steps of:

determining from signals of said magnetometers a unit vector representing the earth's magnetic field with respect to said instrument coordinate system at a first time $t_1$, that is, $h_{t1}$, and a later time $t_2$, that is, $h_{t2}$, determining a difference unit earth magnetic field vector signal, $\Delta h$, representing the difference between $h_{t2}$ and $h_{t1}$ signals, determining from signals of said accelerometers unit vector representing the earth's gravitational field with respect to said instrument coordinate system at said first time $t_1$, that is, $g_{t1}$, and at a later time $t_2$, that is $g_{t2}$, determining a difference unit earth gravitational field vector signal, $\Delta g$ representing the difference between $g_{t2}$ and $g_{t1}$.

determining a signal representative Of the difference in time $\Delta t$ between said first time $t_1$ and said second time $t_2$, and determining from $\Delta h$, h, $\Delta g$, g and $\Delta t$ signals a vector signal $\Omega^p$ representative of the angular rotation velocity of said instrument where h is selected as equal to $h_{t1}$ or $h_{t2}$ or the mean value between $h_{t1}$ and $h_{t2}$ and g is selected as equal to $g_{t1}$ or $g_{t2}$ or the mean value between $g_{t1}$ and $g_{t2}$.

7. The method of claim 6 wherein said instrument is a measurement sub tandemly connected to a drill string.

8. The method of claim 7 wherein said apparatus further includes a gyroscope fixed along each of z, x and y axes of its coordinate system, the method further comprising steps to determine the earth's rotational velocity with respect to said sub coordinate system, such steps including, determining from signals from said gyroscopes a vector signal $\Omega^g$ representative of the rotational velocity of the earth and the rotational velocity of said measurement sub, and determining a vector representative solely of the earth's rotational velocity vector $\Omega^e$ with respect to said sub coordinate system by subtracting said vector signal $\Omega^p$ from said vector signal $\Omega^g$.

9. The method of claim 8 wherein said step of determining a vector signal $\Omega^p$ includes the step of solving the equation, $$\Delta g \times g + (g \cdot \Omega^p \Delta t) g = \Delta h \times h + (h \cdot \Omega^p \Delta t) h.$$

10. The method of claim 9 further comprising the step of determining a maximum likelihood estimate of said vector signal $\Omega^p$.

11. The method of claim 10 wherein the step of computing the maximum likelihood estimate of said vector signal $\Omega^p$ includes the step of minimizing the quantity $$-\frac{1}{2}\begin{bmatrix} \Delta g - \Delta g_{ml} \\ \Delta h - \Delta h_{ml} \end{bmatrix}^T \cdot K^{-1} \begin{bmatrix} \Delta g - \Delta g_{ml} \\ \Delta h - \Delta h_{ml} \end{bmatrix}$$

by treating the three components of said vector signal $\Omega^p$ as free parameters which are allowed to vary, with the value of said vector signal $\Omega^p$ so determined being the maximum likelihood estimate of said vector signal $\Omega^p$, vector signal $\Omega^p_{ml}$.

12. The method of claim 8 further comprising a step to determine the direction of a borehole in which said instrument is placed comprising, generating a signal representative of the direction $\phi$ of said borehole in response to said vector signal $\Omega^e$ representative of earth's rotational velocity and to said vector signals representative of components of earth's gravitational field.

* * * * *